United States Patent [19]

Woods

[11] 4,000,523

[45] Jan. 4, 1977

[54] NECKTIE AND KNOT ARTICLE

[75] Inventor: Walter Woods, New York, N.Y.

[73] Assignee: Lawrene Peska Associates, Inc., New York, N.Y. ; a part interest

[22] Filed: Mar. 17, 1976

[21] Appl. No.: 667,569

[52] U.S. Cl. ..... 2/150; 2/153; 24/49 S

[51] Int. Cl.[2] ..... A41D 25/02

[58] Field of Search ..... 2/147, 153, 152 R, 150, 2/137, 144; 24/49 S, 49 CC, 49 R, 243 R, 243 GC; D2/428

[56] References Cited

UNITED STATES PATENTS

| | | | |
|---|---|---|---|
| 2,553,437 | 5/1951 | Burke | 2/150 |
| 2,821,717 | 2/1958 | Sickerott | 2/147 |

*Primary Examiner*—G. V. Larkin

[57] ABSTRACT

A snap engaging necktie knot piece that includes engaging means such as "Velcro" thereon to engage the necktie.

4 Claims, 1 Drawing Figure

NECKTIE AND KNOT ARTICLE

BACKGROUND OF THE INVENTION

This invention relates to a necktie knot and to a necktie; more particularly, to a simulated knot that is easily applied to the tie where the latter is constructed of loosely knit or rough materials or to a tie and simulated knot combination. In this instance, the tie carries means, set at a predetermined place to engage means on one surface of the simulated knot when placed thereon.

The prior art teaches a variety of neckties and simulated knots, for example, as disclosed in U.S. Pat. Nos. 2,377,019; 2,602,164; 2,714,719; 2,936,462; 3,346,881; 3,562,004; 3,517,395; 3,761,964; and others.

SUMMARY OF THE INVENTION

It is accordingly an object of the instant invention to provide for an improved simulated knot and combination necktie and simulated knot.

It is another object to provide for the foregoing in an attractive article.

It is a further object to provide for the same at relatively little cost thereby making it generally available.

These and other objects and advantages of the invention will become more apparent from the following detailed enclosure and claims and by reference to the accompanying drawings, in which:

Figure 1:
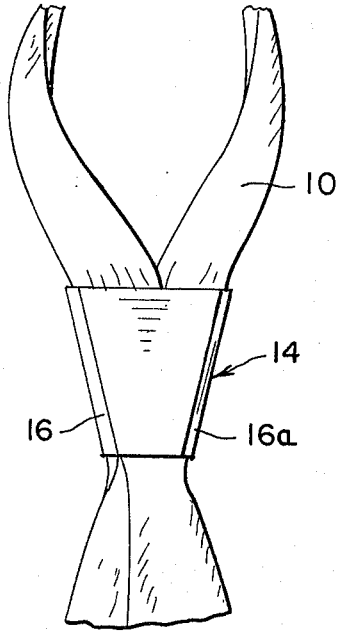
FIG. 1 is a front elevational view.
Figure 2:
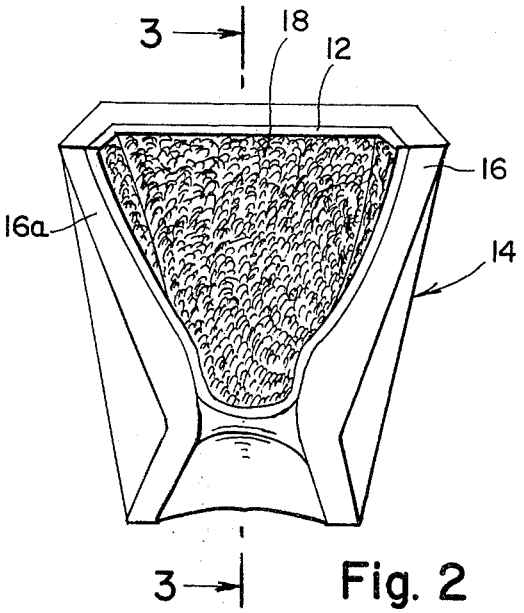
FIG. 2 is a rear elevational view of the simulated knot.
Figure 3:
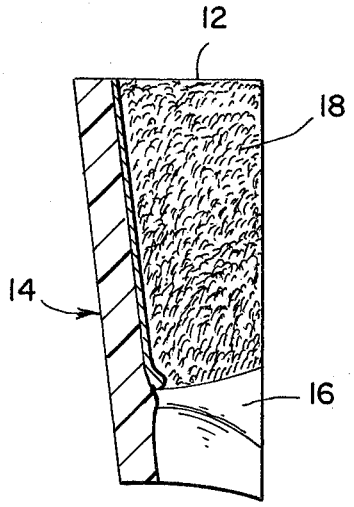
FIG. 3 is a sectional view.

Broadly speaking, the instant invention includes the provision of a necktie supporting attachment comprising an inverted frusto-conical shaped member, the member being rigid and including a pair of lateral flanges defining a groove therebetween, the groove confining a plurality of hooked pile fabric members, the fabric members defining projecting adjacent, barbed splines having hooked end portions adapted to engage the necktie.

DETAILED DISCLOSURE

Referring more particularly to the drawings, there is shown an elongated piece of cloth 10 that may be a conventional necktie in one embodiment or an aspect of the invention in a further embodiment described hereinafter.

In the first embodiment the tie 10 will be constructed of a loosely woven cloth or rough material, such as wool, polyester knits, etc., such that there are inherently provided surface means thereon to engage complementary means 12 that are on one surface of the knot article 14. The simulated knot article 14 is one piece, rigid, frusto-conical shaped member, that has a pair of lateral flanges 16, 16*a* defining a recess or groove 18 therebetween, such that the member 14 does not have a continuous surface such as in a ring, but is rather more adapted to snap engage around the front portion of the tie 10 but not circumferentially engage the same.

Disposed substantially along the grooved surface 18 of the member 14 there is disposed engaging means 12 in the form of a plurality of hooked pile fabric members "Velgro" adhesively secured thereto, which hooked members are adapted to engage the looped pile of the tie 10, such as where it is wool or knit polester. The hooked pile members on the knot 14 are generally stiff, barbed, splines, provided with curved hooks that are adapted to engage loops. For example, as disclosed in U.S. Pat. No. 2,820,277 incorporated herein by reference. The knot 14, with its enlarged or widened area at one end, and narrower area or passage at the opposite end is merely positioned on the tie 10 at the desired spot and the barbed splines engage the same.

In a further embodiment, a necktie is provided that has a cooperating looped pile fabric strip attached at a predetermined spot on the tie for engagement with the knot 14.

Since it is obvious that numerous changes and modifications can be made in the above-described details without departing from the spirit and nature of the invention, it is to be understood that all such changes and modifications are included within the scope of the invention.

I claim:

1. A necktie supporting attachment comprising an inverted frusto-conical shaped member having an inner and outer surface, said member being rigid and including a pair of lateral flanges, each member of said pair defining two converging planes, a median wall communicating between said planes at the point of convergence thereof, said inner surface on one side of said median wall including a plurality of hooked pile fabric members, said fabric members defining projecting adjacent, barbed splines having hooked end portions adapted to engage said necktie.

2. The supporting attachment as defined in claim 1 in combination with a necktie having cooperating looped pile fabric.

3. The supporting attachment as defined in claim 1 wherein said groove is exposed.

4. The supporting attachment as defined in claim 1 wherein said fabric members are adhesively secured to the surface defining said groove.

* * * * *